US009062446B2

(12) United States Patent
Strauch et al.

(10) Patent No.: US 9,062,446 B2
(45) Date of Patent: Jun. 23, 2015

(54) FLOOR ELEMENT FOR FORMING BUILDING BLOCKS

(75) Inventors: Rainer Strauch, Plauen (DE); Ulrich Forster, Bregenz (AT)

(73) Assignee: cree GmbH, Bregenz (AT)

( * ) Notice: Subject to any disclaimer, the term of this patent is extended or adjusted under 35 U.S.C. 154(b) by 0 days.

(21) Appl. No.: 14/110,471

(22) PCT Filed: Mar. 22, 2012

(86) PCT No.: PCT/AT2012/000073

§ 371 (c)(1),
(2), (4) Date: Oct. 8, 2013

(87) PCT Pub. No.: WO2012/135875

PCT Pub. Date: Oct. 11, 2012

(65) Prior Publication Data

US 2014/0030481 A1 Jan. 30, 2014

(30) Foreign Application Priority Data

Apr. 8, 2011 (AT) ..... 502/2011

(51) Int. Cl.

| | |
|---|---|
| ***E04B 5/12*** | (2006.01) |
| ***E04B 5/04*** | (2006.01) |
| ***E04H 1/00*** | (2006.01) |
| *E04B 5/23* | (2006.01) |

(52) U.S. Cl.

CPC ..... *E04B 5/12* (2013.01); *Y10T 428/24331* (2015.01); *Y10T 428/24777* (2015.01); *E04B 2005/232* (2013.01); *E04B 5/046* (2013.01); *E04H 1/00* (2013.01)

(58) Field of Classification Search

USPC ..... 52/334, 327, 602, 336, 236.8; 428/138, 428/192

See application file for complete search history.

(56) References Cited

U.S. PATENT DOCUMENTS

| | | | | | |
|---|---|---|---|---|---|
| 2,004,991 | A | * | 6/1935 | Klotz | 52/781.5 |
| 2,305,252 | A | * | 12/1942 | Hayden | 52/701 |
| 3,363,379 | A | * | 1/1968 | Curran | 52/334 |
| 3,527,007 | A | * | 9/1970 | McManus | 52/327 |
| 3,624,980 | A | * | 12/1971 | McManus | 52/327 |
| 3,728,835 | A | * | 4/1973 | McManus | 52/334 |

(Continued)

FOREIGN PATENT DOCUMENTS

| | | |
|---|---|---|
| AT | 352958 | 10/1979 |
| DE | 1907952 | 1/1965 |

(Continued)

OTHER PUBLICATIONS

Ruske, W, "Holz-Beton-Verbund bei Geschossdecken", Gutersloh, Germany, vol. 46, No. 7, Jul. 1, 1998, pp. 75-78-80.

*Primary Examiner* — James Ference

(74) *Attorney, Agent, or Firm* — Volpe and Koenig, P.C.

(57) ABSTRACT

A floor element for forming building floors, which is designed in the form of a wood/reinforced concrete composite part, includes at least two wood beams (1-4) extending parallel to each other in a longitudinal direction of the floor element and a reinforced concrete body (5), which has a plate-shaped section (6) resting on the wood beams (1-4). Furthermore, the reinforced concrete body (5) has first and second sections designed in the form of edge beams (7, 8), which extend at an angle to the wood beams (1-4) and lie against the opposite end faces (9, 10) of the wood beams (1-4).

14 Claims, 7 Drawing Sheets

(56) References Cited

U.S. PATENT DOCUMENTS

| | | | | | |
|---|---|---|---|---|---|
| 3,979,868 | A * | 9/1976 | Butts et al. | 52/334 |
| 4,285,173 | A * | 8/1981 | Grearson et al. | 52/73 |
| 4,295,310 | A * | 10/1981 | McManus | 52/334 |
| 4,454,695 | A * | 6/1984 | Person | 52/334 |
| 4,566,240 | A * | 1/1986 | Schilger | 52/414 |
| 4,592,184 | A * | 6/1986 | Person et al. | 52/334 |
| 4,604,841 | A * | 8/1986 | Barnoff et al. | 52/174 |
| 4,628,654 | A * | 12/1986 | Boswel | 52/319 |
| 4,685,264 | A * | 8/1987 | Landis | 52/252 |
| 4,700,516 | A * | 10/1987 | Grossman | 52/223.1 |
| 4,841,703 | A * | 6/1989 | Grimaud | 52/334 |
| 4,982,538 | A * | 1/1991 | Horstketter | 52/259 |
| 5,050,366 | A * | 9/1991 | Gardner et al. | 52/847 |
| 5,113,631 | A * | 5/1992 | diGirolamo et al. | 52/236.8 |
| 5,125,200 | A * | 6/1992 | Natterer | 52/223.8 |
| 5,337,532 | A * | 8/1994 | Reid | 52/687 |
| 5,433,049 | A * | 7/1995 | Karlsson et al. | 52/293.2 |
| 5,467,570 | A * | 11/1995 | Leek | 52/712 |
| 5,561,957 | A * | 10/1996 | Gauthier | 52/334 |
| 5,605,423 | A * | 2/1997 | Janusz | 411/387.6 |
| 5,634,308 | A * | 6/1997 | Doolan | 52/334 |
| 5,634,312 | A * | 6/1997 | Tolliver et al. | 52/585.1 |
| 5,749,961 | A * | 5/1998 | Jaklin | 106/672 |
| 5,867,964 | A * | 2/1999 | Perrin | 52/745.1 |
| 5,941,035 | A * | 8/1999 | Purse | 52/263 |
| 6,014,843 | A * | 1/2000 | Crumley et al. | 52/167.3 |
| 6,101,776 | A * | 8/2000 | Conley | 52/379 |
| 6,345,403 | B1 * | 2/2002 | Nagle | 14/77.1 |
| 6,454,181 | B1 * | 9/2002 | Griffith | 238/315 |
| 6,454,505 | B1 * | 9/2002 | Griffith | 411/315 |
| 6,568,139 | B2 * | 5/2003 | Bot | 52/250 |
| 7,028,435 | B2 * | 4/2006 | Walker et al. | 52/236.5 |
| 7,281,357 | B2 * | 10/2007 | Femminella | 52/334 |
| 7,784,235 | B2 * | 8/2010 | Cretti | 52/332 |
| 2001/0039773 | A1 * | 11/2001 | Bot | 52/259 |
| 2002/0174621 | A1 * | 11/2002 | Melland | 52/712 |
| 2003/0093961 | A1 * | 5/2003 | Grossman | 52/250 |
| 2004/0068944 | A1 * | 4/2004 | Dalton | 52/236.9 |
| 2004/0074183 | A1 * | 4/2004 | Schneider et al. | 52/334 |
| 2004/0148885 | A1 * | 8/2004 | Femminella | 52/319 |
| 2005/0086906 | A1 * | 4/2005 | Bathon et al. | 52/782.1 |
| 2006/0236627 | A1 * | 10/2006 | Messenger | 52/272 |
| 2007/0144093 | A1 * | 6/2007 | Messenger et al. | 52/309.12 |
| 2008/0213040 | A1 * | 9/2008 | Morze-Reichartz | 403/381 |
| 2009/0025308 | A1 * | 1/2009 | Deans et al. | 52/92.2 |
| 2009/0025309 | A1 * | 1/2009 | Deans et al. | 52/92.2 |
| 2009/0025311 | A1 * | 1/2009 | Deans et al. | 52/167.3 |
| 2009/0188185 | A1 * | 7/2009 | Studebaker et al. | 52/252 |
| 2009/0188187 | A1 * | 7/2009 | Studebaker et al. | 52/259 |
| 2009/0188192 | A1 * | 7/2009 | Studebaker et al. | 52/321 |
| 2009/0188193 | A1 * | 7/2009 | Studebaker et al. | 52/321 |
| 2009/0188208 | A1 * | 7/2009 | Studebaker et al. | 52/852 |
| 2010/0218443 | A1 * | 9/2010 | Studebaker et al. | 52/236.9 |
| 2012/0073213 | A1 * | 3/2012 | Studebaker et al. | 52/73 |

FOREIGN PATENT DOCUMENTS

| | | |
|---|---|---|
| DE | 9105240 | 8/1991 |
| DE | 29815614 | 2/2000 |
| DE | 10027312 | 12/2001 |
| DE | 10254043 | 7/2004 |
| EP | 0528450 | 2/1993 |
| EP | 0575886 | 12/1993 |

* cited by examiner

FLOOR ELEMENT FOR FORMING BUILDING BLOCKS

BACKGROUND

The invention relates to a floor element for forming building floors, which is designed in the form of a wood/reinforced concrete composite part, wherein the floor element comprises at least two wood beams running parallel to one another in a longitudinal direction of the floor element and a reinforced concrete body, which has a plate-shaped portion resting on the wood beams.

Different embodiments of floor elements that are formed as prefabricated components in the form of wood/reinforced concrete composite parts are already known. These are generally designed with a continuous plate-shaped wood layer, above which a continuous plate-shaped layer formed from reinforced concrete is arranged. In this case, one disadvantage inter alia is that no installation space is provided for building installations, and therefore additional suspended floor constructions have to be used and the load-bearing capacity is limited.

A floor element of the type mentioned in the introduction, in which two or more parallel wood beams are provided which run in a longitudinal direction of the floor element, wherein at least two of the wood beams are spaced apart from one another in a horizontal direction running at right angles to the longitudinal extent of the wood beams, is also already known. The reinforced concrete body, which in particular is plate-shaped, is arranged above these wood beams. In the region between the wood beams, an installation space can thus be provided, by means of which the building installations can be laid. In addition, such a floor element has a high load-bearing capacity. Compared to floor elements produced completely from reinforced concrete, the required quantity of steel can be considerably reduced. A component that is efficient in terms of resources is thus provided.

A problem in constructions which use a previously known floor element of this type is constituted by the need to ensure sufficient safety in case of fire. Such floor elements are normally fastened to continuous vertical wood supports or walls, normally in the regions of the longitudinal ends of the wood beams. A connection that spans stories is thus produced by flammable materials. In accordance with current fire-protection regulations, which set high standards for safety in case of fire, additional encapsulations formed by non-flammable materials or the formation of firewalls of another type would therefore be required, which would lead to high additional construction costs.

SUMMARY

The object of the invention is to provide an improved floor element of the type mentioned in the introduction, by means of which a fireproof construction is enabled in a simple manner. In accordance with the invention, this is achieved by a floor element having one or more of the features of the invention described below.

In the case of the floor element according to the invention, the reinforced concrete body, in addition to the plate-shaped portion which rests on the at least two wood beams of the floor element running parallel to one another in the longitudinal direction of the floor element, comprises first and second portions designed in the form of edge beams. These edge beams run at an angle, for example at right angles, to the wood beams. The first edge beam bears against the end faces of the first ends of the wood beams directed in the same direction.

The second edge beam bears against the opposed end faces of the second ends of the wood beams, which point in a direction opposite to the direction in which the first ends point.

The floor element can be fastened to supports, in particular vertical supports, of the construction via these edge beams since the edge beams rest on the supports supporting the floor element, possibly via intermediate parts. Supporting parts of the construction arranged above the floor element, in particular vertical supports, can rest on the edge beams, possibly via intermediate parts. Stories of the construction arranged one above the other are therefore separated from one another by a continuous layer of mineral material, which is formed by the reinforced concrete bodies of the floor elements, whereby fire is prevented from spreading through the story.

Although a right-angled orientation of the edge beams to the wood beams is expedient for many applications, other angles between the edge beams and the wood beams are also possible depending on the application, wherein the edge beams preferably enclose an angle of at least 45° with the wood beams. Floor elements that have a parallelogram-shaped or trapezoidal outline for example can thus be formed.

All wood beams included in the floor element advantageously run parallel to one another and in the longitudinal direction of the floor element, wherein at least two of the wood beams are spaced apart from one another in the horizontal direction arranged at right angles to the longitudinal direction of floor element (=transverse direction), wherein, for at least two of the wood beams, the distance in the transverse direction is advantageously at least twice the value of the thicknesses of these wood beams measured in the transverse direction. Gaps for laying building installations are therefore also created in the floor.

The wood beams are preferably formed from laminated wood.

In accordance with an advantageous embodiment of the invention, at least one connecting member is connected at each of the two end faces of the at least two wood beams running parallel to one another to the respective wood beam and protrudes beyond the respective end face of the wood beam and is embedded in the concrete of the edge beam bearing against said end face of the wood beam. Tensile forces can thus be transmitted between the edge beams and the wood beams, whereby the overall load-bearing capacity of the floor element can be increased.

For connection of the connecting members to the wood beams, bores are preferably formed in the end faces of the wood beams, and end portions of the connecting members are inserted into said bores, wherein the end portions are held in the bores by means of an adhesive bond.

The connecting members advantageously have a rod-shaped part, wherein, in the region that is embedded in the concrete of the edge beam, a widening of the connecting member is provided. This widening can be formed for example by a nut, which is screwed onto an outer thread of the rod-shaped part designed in the form of a threaded rod, or can be formed by a head, which is secured to the rod-shaped part of the connecting member. An undercut surface can thus be formed, which, due to a form-fit, acts against a removal of the connecting member from the concrete of the edge beam.

On the upper sides of the at least two parallel wood beams, indentations are advantageously formed, into which protrusions of the plate-shaped portion of the reinforced concrete body project, wherein each of the wood beams running in parallel preferably has two or more indentations spaced from one another in the longitudinal direction, into each of which a protrusion of the plate-shaped portion of the reinforced concrete body projects. Shear stresses acting in the longitudinal direction of the wood beams can thus be transmitted between the wood beams and the plate-shaped portion of the reinforced concrete body.

Connecting parts are advantageously connected to the wood beams on the upper sides of the at least two wood beams running in parallel and protrude beyond the upper sides of the wood beams and are embedded in the concrete of the plate-shaped portion of the reinforced concrete body. Shear stresses acting in the longitudinal direction of the wood beams can thus be transmitted between the wood beams and the reinforced concrete body. Furthermore, forces acting in the sense of a lifting of the respective wood beam from the plate-shaped portion of the reinforced concrete body can be taken up by the connecting parts. In an advantageous embodiment of the invention, the connecting parts are designed in the form of screws, which are partly screwed into the wood beams. Widened screw heads in this case form undercut surfaces, which, due to a form fit, act against a removal of the portions of the screws embedded in the concrete.

In an advantageous embodiment of the invention, the floor element, in a central region located in the region of the center lengthwise of the wood beams, has a camber compared to edge regions located in the region of the ends of the wood beams. In other words, when the undersides of the edge beams formed by the reinforced concrete body of the floor element are arranged in the same plane, the upper edge of the plate-shaped portion of the reinforced concrete body in the central region of the floor element is thus arranged higher than in the edge regions located at the ends of the wood beams. Such a camber can be formed preferably in that the at least two wood beams running parallel to one another have a curved course in the longitudinal direction and the plate-shaped portion of the reinforced concrete body follows this curvature (wherein its thickness remains constant). The camber is advantageously more than 10 mm, wherein a value of less than 60 mm is preferred. The long-term creep characteristics of the floor element (which occurs in the range from 1 to 3 years) can be compensated for by this camber.

Since, in contrast to the aesthetic appearance, the load-bearing capacity of the floor element is not negatively influenced by the long-term creep characteristics, it is also possible to dispense with a camber.

Plastic parts, for example polypropylene parts, are advantageously mixed with the concrete of the reinforced concrete body and may melt in case of fire. Cavities are thus formed, in which water vapor of water bound in the concrete can expand in order to counteract a bursting effect of the water bound in the concrete, this effect being present without such cavities in case of fire. The plastic parts mixed in can be designed in the form of fibers.

As a result of the invention, an advantageous floor element of wood/reinforced concrete composite design is provided, in which a reinforced concrete body comprises a plate-shaped portion and portions that are formed in one piece therewith and form the edge beams.

A floor element according to the invention is suitable in particular for forming floors running between stories of multi-story buildings. In this case, the building preferably has at least three stories above the ground floor.

BRIEF DESCRIPTION OF THE DRAWINGS

Further advantages and details of the invention will be explained hereinafter on the basis of the accompanying drawing, in which.

DETAILED DESCRIPTION OF THE PREFERRED EMBODIMENTS

Figure 1:
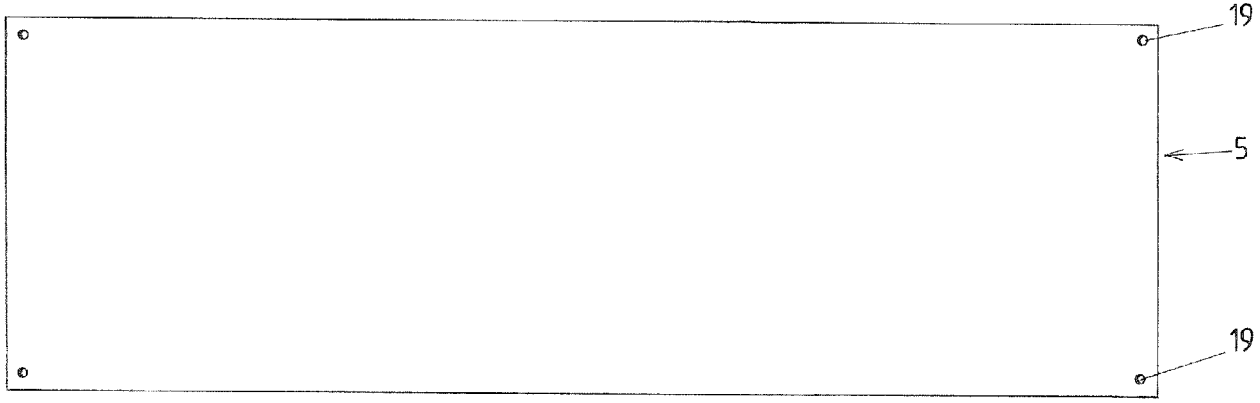
FIGS. 1 and 2 show a plan view and view from below of an exemplary embodiment of a floor element according to the invention.

An exemplary embodiment for a floor element according to the invention is illustrated in FIGS. 1 to 10.

In the illustrated exemplary embodiment, the floor element has four wood beams 1-4, which in plan view rest parallel to one another on the floor element and extend in a longitudinal direction, which corresponds to the longitudinal direction of the floor element. The wood beams 1-4 are aligned as viewed in the transverse direction arranged at right angles to the longitudinal direction and directed horizontally.

Two of these wood beams 1, 2 are arranged in a central region (based on the transverse direction) of the floor element, and the end faces of these wood beams 1, 2 pointing toward one another are arranged at only a short distance from one another (this is less than a tenth of the thicknesses of the wood beams 1, 2 measured in the transverse direction). The side faces could also bear against one another, or a greater distance between the side faces could be provided. The two further wood beams 3, 4 are arranged on either side of the two central wood beams 1, 2 and at a distance therefrom, wherein gaps 27, 28 are formed.

A floor element according to the invention could also have wood beams 1-4 running more or less parallel in the longitudinal direction of the floor element.

The floor element further has a reinforced concrete body 5 connected to the wood beams 1-4. This body comprises a plate-shaped portion 6, which rests on the wood beams 1-4, and first and second portions designed in the form of edge beams 7, 8, which bear against the end faces 9, 10 of the wood beams 1-4 arranged at the opposed ends of the wood beams 1-4.

In the illustrated exemplary embodiment, the wood beams 3, 4 bear against the longitudinal-side side edges of the floor element, that is to say the wood beams 3, 4 and the plate-shaped portion 6 of the reinforced concrete body 5 terminate flush with one another at these side edges. It would also be conceivable and possible for the wood beams 3, 4 to run at a distance from these side edges, that is to say for the plate-shaped portion 6 to protrude beyond the wood beams 3, 4 in the region of the two longitudinal-side side edges.

Instead of the two central wood beams 1, 2 an individual central wood beam could also be provided. This would then preferably have a thickness (measured in the transverse direction) greater than the edge-side wood beams 3, 4.

A floor element according to the invention could also be formed with just two parallel wood beams running longitudinally and distanced from one another. On the other hand, a floor element according to the invention could also have more than four parallel wood beams running in the longitudinal direction which are spaced from one another at least in part. The wood beams 1-4 preferably are formed of laminated wood.

The edge beams 7, 8 in the illustrated exemplary embodiment run at right angles to the wood beams 1, 4, such that, as viewed in plan view, a floor element having an outer contour that is rectangular on the whole is produced. It would also be conceivable and possible for the edge beams 7, 8 to run at a different angle to the wood beams 1-4, wherein this angle is preferably at least 45°. Floor elements with other outer contours as viewed in plan view, for example trapezoidal or parallelogram-shaped floor elements, can thus be formed.

At least one connecting member 11 is provided at each of the two end faces 9, 10 of a respective wood beam 1-4 and is connected to the wood beam 1-4 and protrudes beyond the respective end face 9, 10. In the region protruding beyond the end face, the connecting member 11 is embedded in the concrete of the edge beam 7, 8 which bears against the respective end face 9, 10. In the shown exemplary embodiment, two such connecting members 11 are provided at each end face 9, 10 of each wood beam 1-4. More or fewer connecting members could be provided at the end faces 9, 10 of one, more, or all of the wood beams 1-4.

The connecting members 11 are formed in the shown exemplary embodiment by threaded rods 12, onto which nuts 13 are screwed. A respective threaded rod 12 is inserted over part of its length into a blind-hole-shaped drill hole, which is introduced into the wood beams starting from the respective end face 9, 10 of the respective wood beam 1-4, preferably in the longitudinal direction of the wood beam. The respective threaded rod 12 is glued into this drill hole using a suitable adhesive. The nut 13 is screwed onto the portion of the threaded rod 12 protruding beyond the end face 9, 10 and is thus embedded in the concrete of the respective edge beam 7, 8.

Other, preferably substantially rod-shaped, embodiments of the threaded rods 12 are possible, wherein a jutting part of the connecting member 11 in the portion protruding beyond the end face 9, 10 is advantageous in order to form an undercut surface counteracting a tearing out of the connecting member 11 in a direction arranged in the longitudinal direction of the wood beams 1-4.

Figure 2:
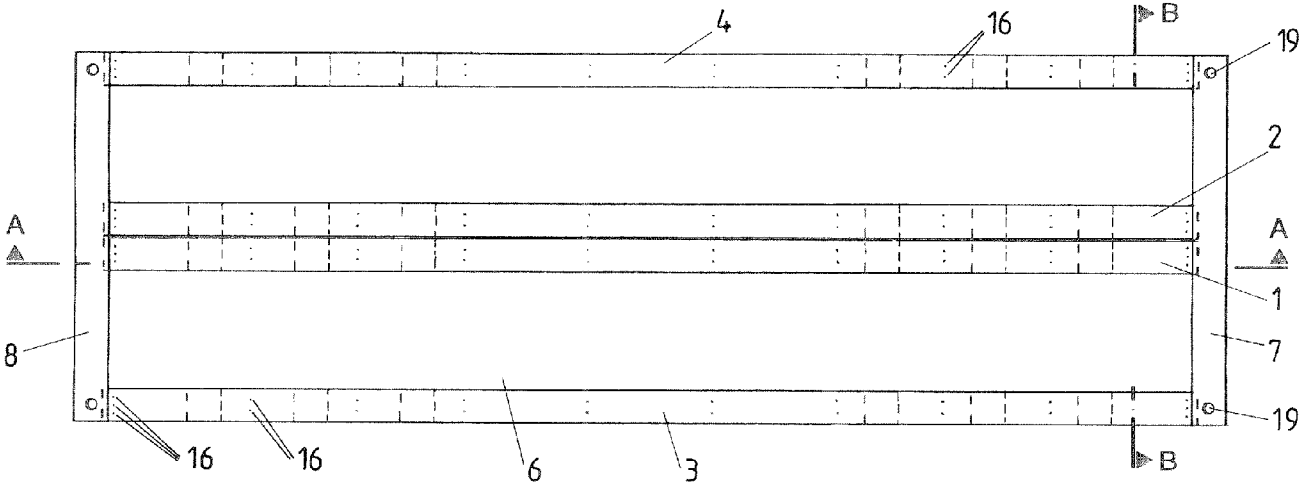
Figure 3:
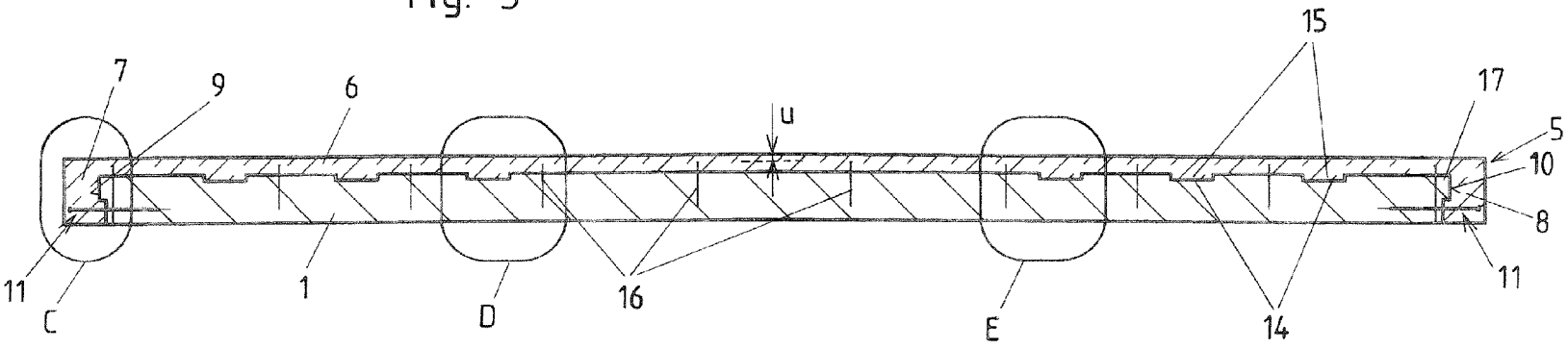
FIG. 3 shows a section along line AA from FIG. 2.
Figure 4:
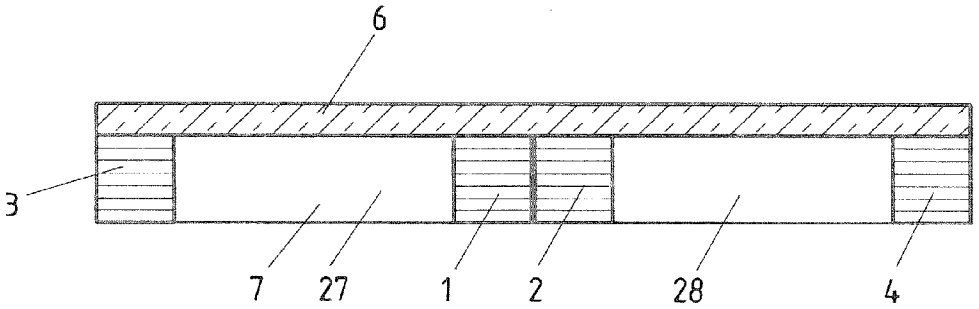
FIG. 4 shows a section along line BB from FIG. 2.
Figure 6:
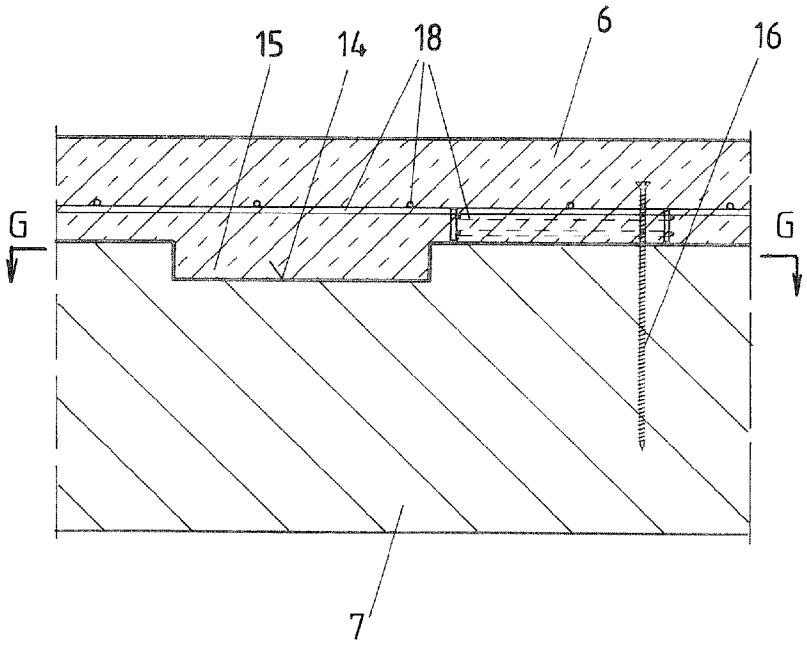
FIG. 6 shows an enlarged detail D from FIG. 3.
Figure 5:
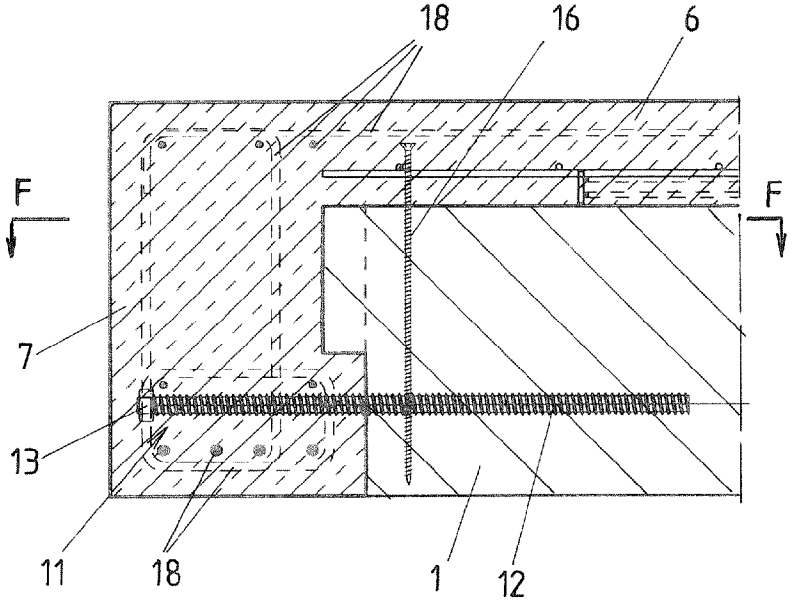
FIG. 5 shows an enlarged detail C from FIG. 3.
Figure 8:
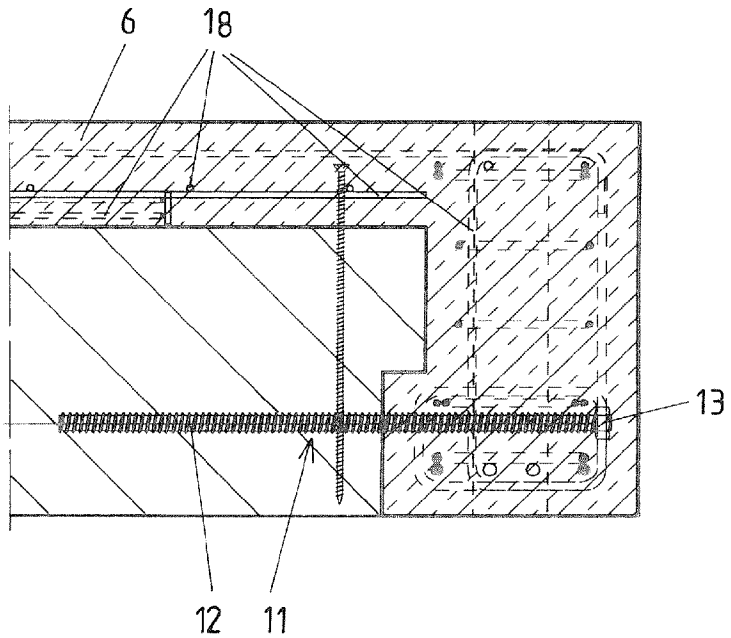
FIG. 8 shows part of a section similar to the section AA, which runs however through the edge-side wood beams arranged above in FIG. 2, in the region of the side edge of the floor element arranged to the right in FIG. 2.
Figure 7:
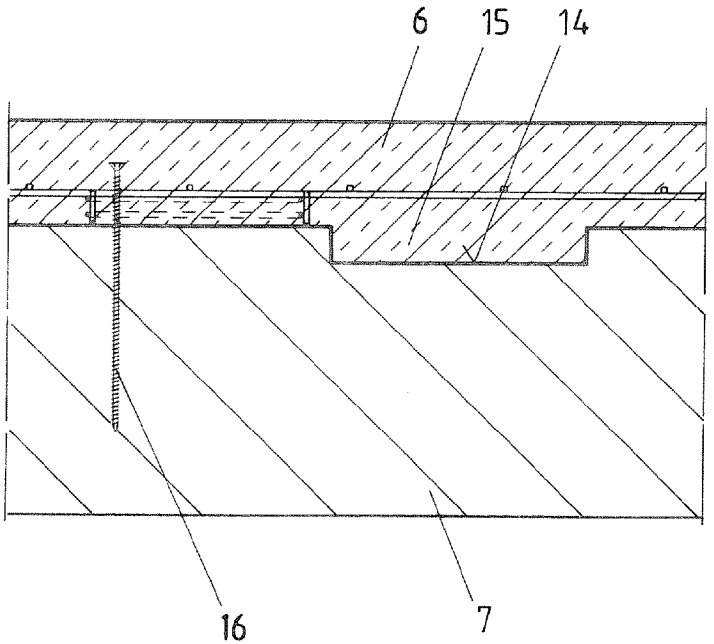
FIG. 7 shows an enlarged detail E from FIG. 3.
Figure 10:
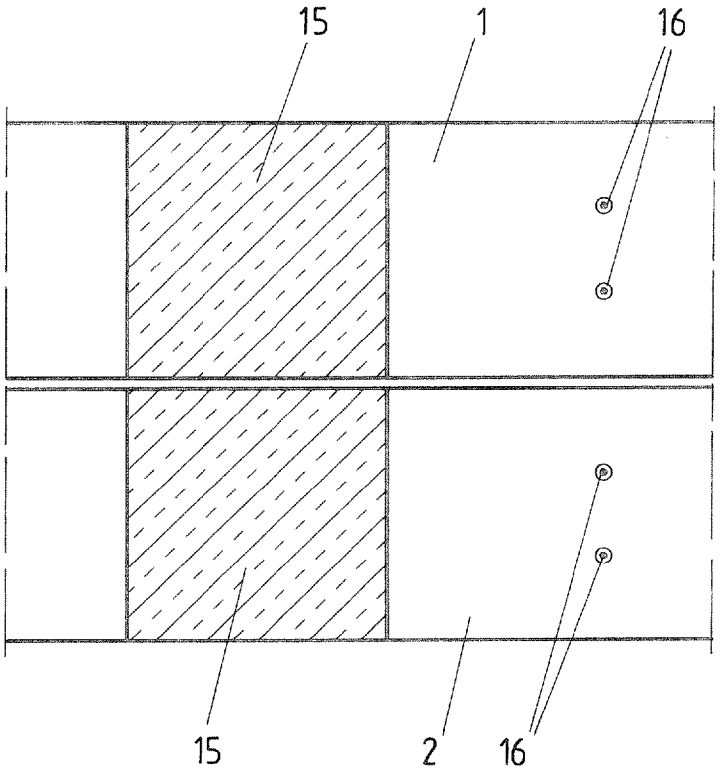
FIG. 10 shows a section along the line GG from FIG. 6.
Figure 9:
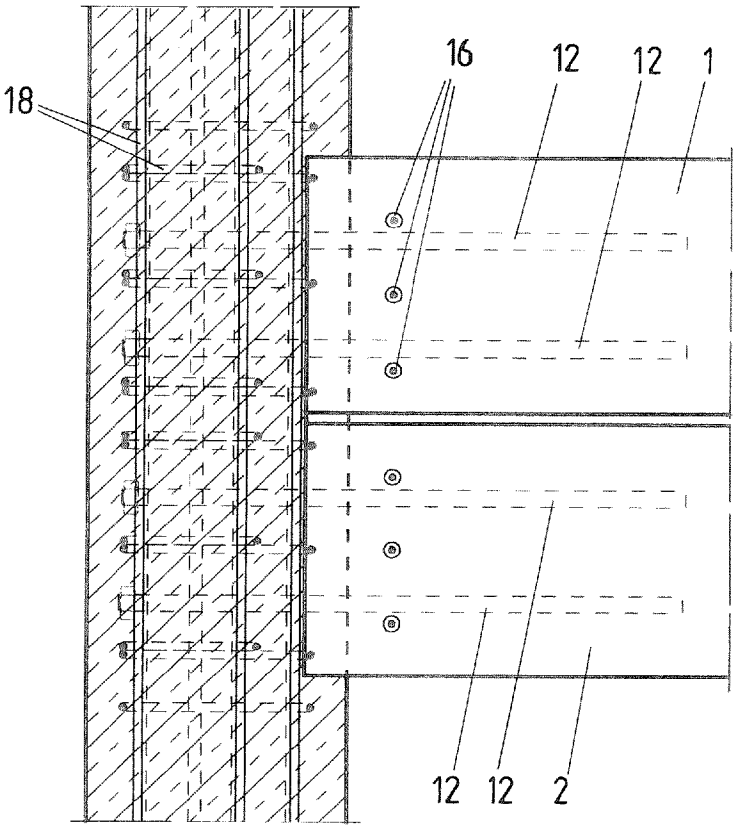
FIG. 9 shows a section along the line FF from FIG. 5.

On its upper sides facing toward the plate-shaped portion 6, a plurality of indentations 14 spaced in the longitudinal direction of the wood beams 1-4 are formed in each of the wood beams 1-4, as can be seen from FIG. 3 for example. In FIG. 2, the indentations are indicated by dashed lines. Lobe-like protrusions 15 of the plate-shaped portion 6 protrude into these indentations. A connection acting in the longitudinal direction of the wood beams 1-4 is thus formed between the plate-shaped portion 6 and the wood beams 1-4.

More or fewer than the six indentations 14 illustrated in FIG. 3 and six protrusions 15 protruding thereinto can be provided, wherein at least two indentations 14 spaced from one another in the longitudinal direction of the wood beam and protrusions 15 protruding thereinto are preferably provided per wood beam 1-4. The edges defining the indentations 14 at the two longitudinal ends of the respective indentation 14 are preferably oriented at right angles to a horizontal plane, as viewed in longitudinal section through the wood beams, or approach one another upwardly (that is to say the indentations 14 are undercut at the two longitudinal ends). Faces of the wood beams 1-4 and of the plate-shaped portion 6 bearing against one another and counteracting a longitudinal displacement between the wood beams 1-4 and the plate-shaped portion 6 on account of a form-fit are thus formed.

Connecting parts 16 are connected to the upper sides of the wood beams 1-4, a portion of each of said connecting parts protruding beyond the upper side of the respective wood beam 1-4 which is embedded in the concrete of the plate-shaped portion 6. These connecting parts 16 are formed in the shown exemplary embodiment by screws screwed into the wood beams. A plurality of connecting parts 16 are advantageously provided per wood beam, wherein such connecting parts 16 are connected to the wood beam 1-4 at points spaced from one another in the longitudinal direction of the respective wood beam 1-4. In FIG. 2, the points at which such connecting parts 16 are provided are indicated by dots.

The end faces 9, 10 of the wood beams 1-4 bearing against the longitudinal ends of the wood beams 1-4 are each formed with a rabbet. An upper portion 17 protruding in the longitudinal direction is formed as a result and projects into an indentation in the edge beam 7, 8, which bears against the respective end face 9, 10 of the wood beam 1-4. The respective edge beam 7, 8, on its side face facing towards the wood beams 1-4, thus has, for a respective wood beam 1-4, a rabbet corresponding to the rabbet of the wood beam 1-4, the respective end face 9, 10 of the respective wood beam 1-4 bearing against said rabbet.

The wood beams 1-4 run vertically in a slightly curved manner in their longitudinal direction. The plate-shaped portion follows this curvature, wherein it has the same thickness in the region of the ends of the wood beams 1-4 as in the central region of the wood beams. A camber u in the central region of the floor element based on the longitudinal extent of the wood beams 1-4 is thus produced and is illustrated in FIG. 3. The size of this camber u may be 25 mm for example. Larger or smaller values may be expedient according to the embodiment of the floor element. The long-term creep characteristics can be compensated for as a result of this camber, such that the surface of the plate-shaped portion 6 is substantially flat in the installed state after a specific period of time, which for example may lie in the range from 1-3 years.

If not opposed for design reasons, the camber can also be omitted, that is to say u is equal to 0.

Plastic parts, for example polypropylene fibers, are preferably embedded in the concrete of the reinforced concrete body 5 and may melt in case of fire. Cavities, into which water vapor produced by the evaporation of water bound in the concrete can infiltrate, are thus formed. A blasting effect of such water vapor otherwise present is thus eliminated.

The accordingly preformed wood beams 1-4 provided with connecting members 11 and connecting parts 16 are preferably placed in a mold for production of a floor element according to the invention. Steel reinforcement parts 18, which may be formed in the conventional manner, are inserted. The concrete is then poured in. A self-compacting concrete ("SCC concrete") is advantageously used so that a course of the upper side of the plate-shaped portion 6 following the curved course of the hollow beams 1-4 can be formed.

Although prefabrication of the floor elements in a factory and supply of the prefabricated floor elements to the installation site is advantageous, in situ production on a lost framework is also possible.

Through-openings 19, which, in the assembled state of the floor element in which the undersides of the edge beams 7, 8 are arranged in a common horizontal plane, run vertically, are formed in the corner regions of the reinforced concrete body, that is to say in the end regions of the edge beams 7, 8. These through-openings 19 are preferably formed by arranging pipes, preferably corrugated pipes, at the points of the through-openings 19 to be formed before the concrete is poured in.

Figure 11:
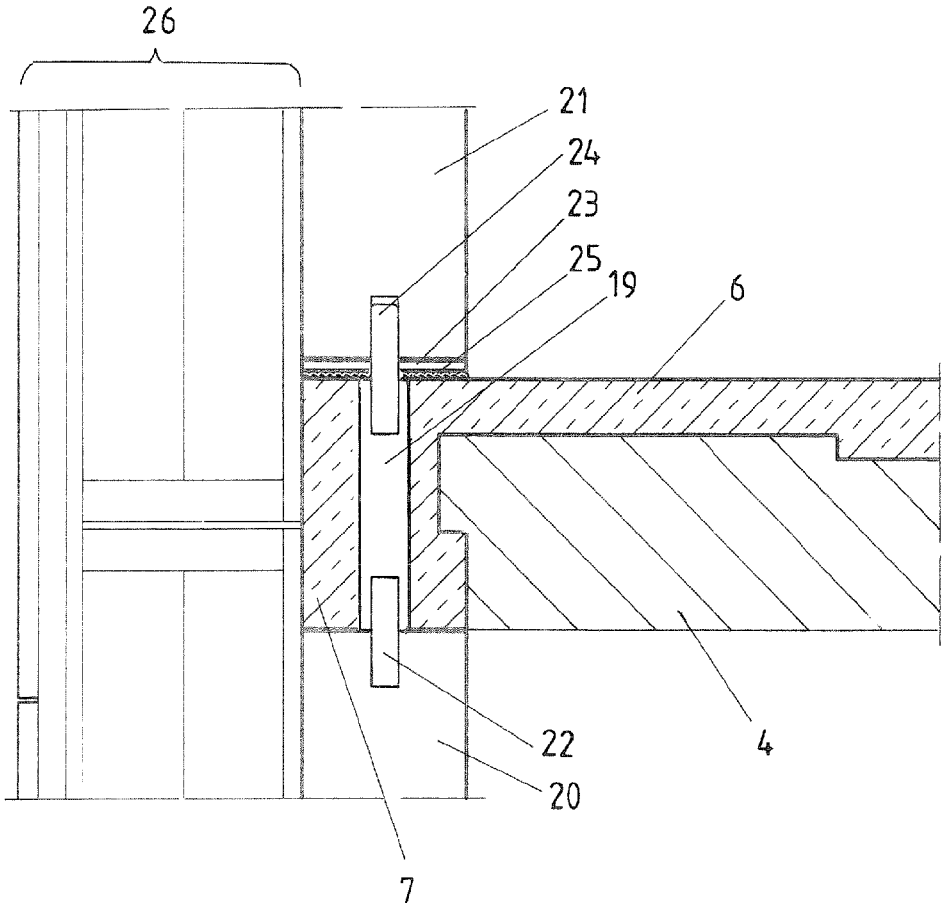
FIG. 11 shows a schematic vertical section thorough a portion of a building in the region of an attachment of the floor element to vertical supports of the building.

The attachment of a floor element according to the invention to vertical supports 20, 21 of the building construction is illustrated in FIG. 11. The supports 20, 21 preferably are formed of wood. A centering pin 22 is inserted into a blind hole introduced into the upper end face of the lower support 20, on which the edge beam 7 of the floor elements rests, and protrudes upwardly beyond the upper end face of the support 20 and projects into the through-opening 19 in the edge beam 7. A base plate 23 is arranged above the edge beam 7 and is provided with a centering pin 24 passing through it and fixed thereto. The centering pins 22, 24 preferably are formed of steel. The base plate 23 preferably is formed of steel, and the centering pin 24 is fixedly welded thereto and protrudes beyond the flat base plate 23 on either side at right angles. As required, the base plate 23 is arranged on a base plate 25 for compensation of any manufacturing tolerances, and the downwardly protruding portion of the centering pin 24 projects from above into the through-opening 19 in the edge beam 7. The portion of the centering pin 24 protruding upwardly from the base plate 23 projects into a blind hole at the lower end of the upper vertical support 21. Separate upwardly protruding and downwardly protruding centering pins 24 could also be fixed to the base plate 23.

At the other end of the floor element, said element is incorporated into the bearing structure of the building in a similar manner via the edge beam 8.

The edge beams 7, 8 thus rest on the bearings supporting the floor element, and the weight of the floor element is transmitted to the bearings via the edge beams 7, 8.

Support parts arranged above the floor element, which in the shown exemplary embodiment are formed by the upper vertical supports 21, transmit, via the respective edge beams 7, 8, the forces acting thereon to the respective supports supporting the floor element, which in the illustrated exemplary embodiment are formed by the lower vertical supports 20.

A facade structure 26 is also indicated, again schematically, in FIG. 11 and can be formed in the conventional manner and does not require further explanation.

Figure 12:
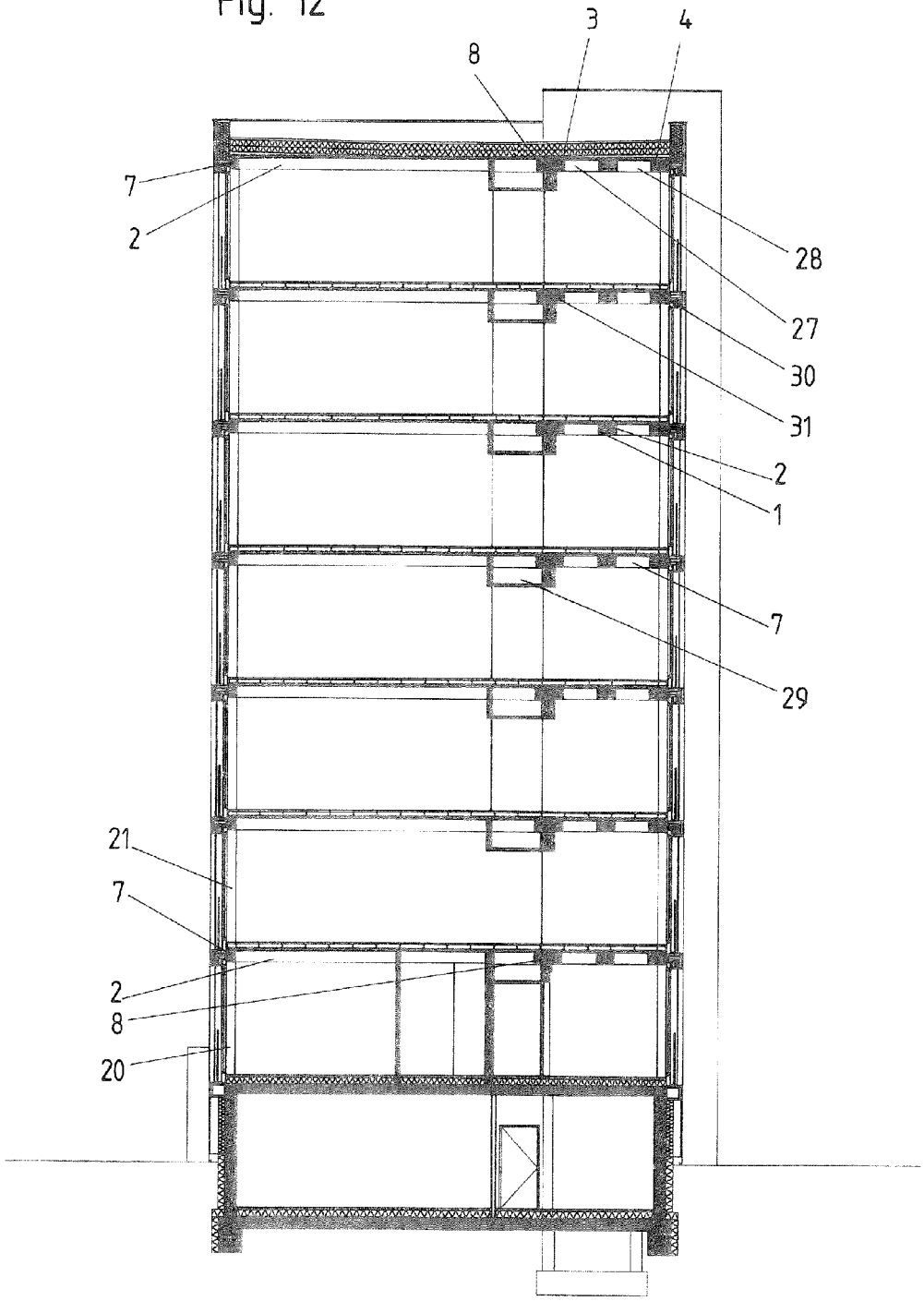
FIG. 12 shows a schematic vertical section through a multi-story building, in which floor elements according to the invention are used, as an example for a possible application of the floor element.

FIG. 12, by way of example, shows a simplified vertical section through a building, in which floor elements according to the invention are used. The building is multi-storied. In the exemplary embodiment of FIG. 12, seven stories are formed above the ground floor, and the floors of said stories are each formed with the use of floor elements according to the invention.

A building, in which building floors are formed with floor elements according to the invention, for example at least all building floors between stories that are arranged above the ground floor, may have three or more stories arranged above the ground floor, for example more than five stories arranged above the ground floor. Such floor elements can also be used in buildings having fewer stories.

As illustrated in FIG. 12, floor elements can be used in this case in different orientation of the longitudinal extent of the wood beams 1-4, in particular with orientations rotated through 90°. A floor element for each story can be seen to the left in FIG. 12 and is cut in the longitudinal direction. To the right in FIG. 12, a floor element that is cut in transverse direction can be seen for each story.

Building installations, such as electrical lines and/or water-carrying lines and/or ventilation lines (not illustrated in FIG. 12), can be laid in the gaps 27, 28 between the wood beams 1-4 on the underside of a respective floor element. In FIG. 12, one suspended floor paneling 29 is illustrated per story and is produced in dry construction. This is used for the transverse distribution of building installations.

Finished-part edge bolts 30, 31 are arranged on either side of the floor element arranged to the right in FIG. 12 and cut transversely.

The exemplary embodiment of a floor element according to the invention illustrated in the Figures is symmetrical about two axes, that is to say is symmetrical both based on the longitudinal direction and based on the transverse direction relative to the wood beams 1-4. Although advantages in terms of the handling and assembly are achieved as a result of this, other embodiments are also conceivable and possible.

The length of a floor element according to the invention measured in the longitudinal direction of the wood beams 1-4 may advantageously be more than 5 m, for example may lie in the region of 8 m or more. This span can be bridged without intermediate support, that is to say only by means of supports on which the edge beams 7, 8 rest.

The width of a floor element measured transversely to the wood beams 1-4 may lie for example in the range from 2.5 to 3 m. Larger or smaller widths are also possible.

KEY TO THE REFERENCE NUMERALS

1 wood beam
2 wood beam
3 wood beam
4 wood beam
5 reinforced concrete body
6 plate-shaped portion
7 edge beam
8 edge beam
9 end face
10 end face
11 connecting member
12 threaded rod
13 nut
14 indentation
15 protrusion
16 connecting part
17 upper portion
18 reinforcement part
19 through-opening
20 support
21 support
22 centering pin
23 base plate
24 centering pin
25 base plate
26 facade structure
27 gap
28 gap
29 floor paneling
30 finished-part edge bolt
31 finished-part edge bolt

The invention claimed is:

1. A composite floor element comprised of wood and reinforced concrete for forming building floors, comprising at least two wood beams running parallel to one another in a longitudinal direction of the floor element and a reinforced concrete body, which has a plate portion resting on the wood beams, each of the at least two wood beams having a first end face and a second end face located at opposed ends thereof, said first and second end faces face away from one another, the reinforced concrete body further has first and second portions that form edge beams which extend at an angle to the wood beams and bear against the first and second end faces of the wood beams;

wherein the end faces of each of the wood beams are each formed with a rabbet and a side face of a respective one of the edge beams bearing against the end face of each of the wood beams has a corresponding rabbet, against which the rabbet of the end face of each of the wood beams bears; and at least one connecting member connected to each of the wood beams at each of the two opposed end faces of each of the wood beams, each of the connecting members has a first portion which protrudes into a respective one of the end faces of one of a respective one of the wood beams and a second portion which protrudes beyond the respective end face of the respective one of the wood beams and is embedded in the concrete of the respective edge beam.

2. The floor element as claimed in claim 1, wherein each respective one of the connecting members has a rod part.

3. The floor element as claimed in claim 2, wherein each respective one of the connecting members has a threaded rod.

4. The floor element as claimed in claim 3, wherein at least one nut is screwed onto a portion of the threaded rod that protrudes beyond the respective end face of the respective one of the wood beams.

5. The floor element as claimed in claim 1, wherein each respective one of the connecting members is glued into a bore introduced into a respective end face of the respective wood beam.

6. The floor element as claimed claim 1, wherein the floor element, in a central region located in a center area lengthwise of the wood beams, has a camber compared to an area at the ends of the wood beams.

7. The floor element as claimed in claim 1, wherein the floor element further comprises plastic parts, and the plastic parts are capable of melting in case of fire are embedded in the concrete of the reinforced concrete body.

8. The floor element as claimed in claim 1, wherein the wood beams are laminated wood beams.

9. The floor element as claimed in claim 1, wherein the floor element is installed in floors between stories of a multi-story building.

10. The floor element as claimed in claim 9, wherein the building has at least three stories arranged above a ground floor.

11. A composite floor element comprised of wood and reinforced concrete for forming building floors, comprising at least two wood beams running parallel to one another in a longitudinal direction of the floor element and a reinforced concrete body, which has a plate portion resting on the wood beams, the reinforced concrete body further has first and second portions that form edge beams which extend at an angle to the wood beams and bear against two opposed end faces of the wood beams;

wherein the end faces of each of the wood beams are each formed with a rabbet and a side face of a respective one of the edge beams bearing against the end face of a respective one of the wood beams has a corresponding rabbet, against which the rabbet of the end face of the respective wood beam bears; and at least one connecting member connected to each of the wood beams at each of the two opposed end faces of a respective one of the wood beams, the connecting member has a first portion which protrudes into the wood beam and a second portion which protrudes beyond the respective end face of the respective one of the wood beams and is embedded in the concrete of the respective edge beam, and for transmission of shear stresses between the wood beams and the plate portion of the reinforced concrete body, each of the wood beams has, on an upper side thereof, at least one indentation, into which a protrusion of the plate-shaped portion projects.

12. The floor element as claimed in claim 11, wherein the upper side of a respective one of the wood beams is provided with two or more indentations, which are spaced in the longitudinal direction and into each of which one of the protrusions of the plate-shaped portion of the reinforced concrete body projects.

13. A composite floor element comprised of wood and reinforced concrete for forming building floors, comprising at least two wood beams running parallel to one another in a longitudinal direction of the floor element and a reinforced concrete body, which has a plate portion resting on the wood beams, the reinforced concrete body further has first and second portions that form edge beams which extend at an angle to the wood beams and bear against two opposed end faces of the wood beams;

wherein the end faces of each of the wood beams are each formed with a rabbet and a side face of a respective one of the edge beams bearing against the end face of a respective one of the wood beams has a corresponding rabbet, against which the rabbet of the end face of the respective wood beam bears; and at least one connecting member connected to each of the wood beams at each of the two opposed end faces of a respective one of the wood beams, the connecting member has a first portion which protrudes into the wood beam and a second portion which protrudes beyond the respective end face of the respective one of the wood beams and is embedded in the concrete of the respective edge beam, and for connection between the at least two wood beams running in parallel and the plate-shaped portion of the reinforced concrete body, connecting parts are provided, which are connected to the respective wood beam and protrude beyond an upper side of the wood beam and are embedded in the concrete of the plate-shaped portion of the reinforced concrete body.

14. The floor element as claimed in claim 13, wherein the connecting parts are screws, which are screwed into the respective wood beams.

* * * * *